US009659708B2

(12) United States Patent
Wi et al.

(10) Patent No.: US 9,659,708 B2
(45) Date of Patent: May 23, 2017

(54) METHOD FOR MANUFACTURING AN INDUCTOR

(71) Applicant: Samsung Electro-Mechanics Co., Ltd., Gyunggi-Do (KR)

(72) Inventors: Sung Kwon Wi, Seoul (KR); Young Seuck Yoo, Seoul (KR); Jeong Bok Kwak, Gyeonggi-do (KR); Yong Suk Kim, Gyeonggi-do (KR); Sang Moon Lee, Seoul (KR); Kang Heon Hur, Gyeonggi-do (KR)

(73) Assignee: SAMSUNG ELECTRO-MECHANICS CO., LTD., Gyunggi-Do (KR)

( * ) Notice: Subject to any disclaimer, the term of this patent is extended or adjusted under 35 U.S.C. 154(b) by 235 days.

(21) Appl. No.: 13/953,580

(22) Filed: Jul. 29, 2013

(65) Prior Publication Data

US 2013/0316291 A1 Nov. 28, 2013

Related U.S. Application Data

(62) Division of application No. 13/402,804, filed on Feb. 22, 2012, now abandoned.

(30) Foreign Application Priority Data

Nov. 25, 2011 (KR) ..... 10-2011-0124298

(51) Int. Cl.

| | |
|---|---|
| ***H01F 41/04*** | (2006.01) |
| ***H01F 17/00*** | (2006.01) |
| ***H01F 27/29*** | (2006.01) |

(52) U.S. Cl.

CPC ..... *H01F 41/04* (2013.01); *H01F 17/0013* (2013.01); *H01F 27/292* (2013.01); *H01F 41/041* (2013.01); *Y10T 29/4902* (2015.01)

(58) Field of Classification Search

CPC ..... H01F 2027/2809; H01F 29/292; H01F 41/04; H01F 41/041; Y10T 29/4902

See application file for complete search history.

(56) References Cited

U.S. PATENT DOCUMENTS

| | | | | |
|---|---|---|---|---|
| 6,154,114 | A | 11/2000 | Takahashi | |
| 6,194,248 | B1 * | 2/2001 | Amaya | H01F 17/0006 205/204 |
| 6,452,110 | B1 | 9/2002 | Clevenger et al. | |
| 8,237,279 | B2 | 8/2012 | Daubenspeck et al. | |

(Continued)

FOREIGN PATENT DOCUMENTS

| | | | |
|---|---|---|---|
| JP | 11-204336 | A | 7/1999 |
| JP | 2000-040633 | A | 2/2000 |

(Continued)

OTHER PUBLICATIONS

Dupont Corp. "Summary of Properties for Kapton® Polyimide Films". https://www.google.com/url?sa=t&rct=j&q=&esrc=s&source=web&cd=1&cad=rja&uact=8&ved=0CB8QFjAA&url=http%3A%2F%2Fwww.dupont.com%2Fcontent%2Fdam%2Fassets%2Fproducts-and-services%2Fmembranes-films%2Fassets%2FDEC-Kapton-summary-of-properties.pdf&ei=TeFZVa_2FpHLsATTl4GgCg&usg=AFQjCNGKOd0RS3.*

(Continued)

*Primary Examiner* — Peter DungBa Vo
*Assistant Examiner* — Jeffrey T Carley
(74) *Attorney, Agent, or Firm* — McDermott Will & Emery LLP

(57) ABSTRACT

A method for manufacturing an inductor including preparing an insulating layer; forming a polymer layer including a coil pattern on the insulating layer; forming a stacked structure by heat treating the insulating layer and the polymer layer; and forming an external electrode to electrically connect the coil pattern for the stacked structure.

6 Claims, 3 Drawing Sheets

(56) References Cited

U.S. PATENT DOCUMENTS

| | | | | |
|---|---|---|---|---|
| 2004/0195000 | A1* | 10/2004 | Ryhanen | H01C 17/06 174/260 |
| 2006/0079025 | A1 | 4/2006 | Kripesh et al. | |
| 2006/0152321 | A1* | 7/2006 | Jung | H01F 17/0006 336/200 |
| 2007/0069844 | A1 | 3/2007 | Kudo et al. | |
| 2007/0182521 | A1* | 8/2007 | Lin | H01L 23/5223 336/200 |
| 2008/0023219 | A1 | 1/2008 | Yoshizawa et al. | |
| 2010/0052135 | A1 | 3/2010 | Shim et al. | |
| 2010/0157565 | A1* | 6/2010 | Yoshida | H01F 27/292 361/811 |
| 2011/0133881 | A1 | 6/2011 | Nakajima et al. | |

FOREIGN PATENT DOCUMENTS

| | | | |
|---|---|---|---|
| JP | 2000-508116 | A | 6/2000 |
| JP | 2003-158015 | A | 5/2003 |
| JP | 2003-158015 | A | 5/2003 |
| JP | 2003158015 | A | 5/2003 |
| JP | 2005-109097 | A | 4/2005 |
| JP | 2005109097 | A | 4/2005 |
| JP | 2006-324462 | A | 11/2006 |
| JP | 2008-34626 | A | 2/2008 |
| JP | 2008-064326 | A | 2/2008 |
| JP | 2010-062412 | A | 3/2010 |
| JP | 2010-287722 | A | 12/2010 |

OTHER PUBLICATIONS

JP 2012-033668 Office Action dated Jun. 3, 2014; 2pgs.

U.S. Appl. No. 13/402,804 Office Action dated Jan. 2, 2015; 19pgs.

JP 2012-033668 Office Action dated Mar. 31, 2015; 3pgs.

Notice of Office Action Japanese Patent Application No. 2012-033668 dated Mar. 8, 2016 with full English translation.

* cited by examiner

METHOD FOR MANUFACTURING AN INDUCTOR

CROSS-REFERENCE TO RELATED APPLICATIONS

Claim and incorporate by reference domestic priority application and foreign priority application as follows:

Cross Reference to Related Application

This application claims the benefit under 35 U.S.C. Section 119 of Korean Patent Application Serial No. 10-2011-0124298, entitled filed Nov. 25, 2011, which is hereby incorporated by reference in its entirety into this application.

BACKGROUND OF THE INVENTION

1. Field of the Invention

The present invention relates to an inductor and a method for manufacturing the same, and more particularly, to an inductor having a high Q characteristics and a method for manufacturing the same.

2. Description of the Related Art

In recent times, as the miniaturization and multi-functions of mobile devices are in progress, electronic elements also becomes to be ultra slim. In order to meet this trend, there is required for an inductance having high accuracy and high Q characteristics. A conventional method for manufacturing a stacked inductor prepares dielectric ceramic insulating sheets, prints a coil pattern and conductive via using a screen printing process and a thick layer process or the like to the insulating sheets, forms a stacked structure through a process to press and sinter the insulating sheets and forms electrodes on an outside of the stacked structure.

However, the above-described stacked inductor may generate phenomena such as electrode blurs in a process to print the coil pattern and conductive vias, alignment failures in pressing the insulating sheets and coil deformation due to an electrode dent or the like. And also, in case when the insulating sheets made of ceramic materials are used, the stacked material formed thereon the coil pattern has a limit to increase the Q characteristics since the dielectric constant has a relatively high. Accordingly, a conventional inductor is difficult to control a desired inductance value, has a great designed inductance deviation, and is difficult to implement a low direct current resistance.

PRIOR ART REFERENCES

Patent References (Patent reference 1) 1. Japanese issued patent No.: JP4755453

(Patent reference 2) 2. Japanese laid open patent No.: JP2005-109097

SUMMARY OF THE INVENTION

The present invention has been invented in order to overcome the above-described problems and it is, therefore, an object of the present invention to provide an inductor having high Q characteristics.

In accordance with another aspect of the present invention, it is another object of the present invention to provide an inductor having a structure to easily control an inductance and reduce the deviation of designed inductance by having a fine pitched coil pattern.

Further, in accordance with another aspect of the present invention, it is another object of the present invention to provide a method for manufacturing an inductor capable of improving high Q characteristics.

Further, in accordance with another aspect of the present invention, it is another object of the present invention to provide a method for manufacturing an inductor capable of easily controlling an inductance and reducing the deviation of designed inductance by implementing a fine pitch of the coil pattern of the inductor.

In accordance with one aspect of the present invention to achieve the object, there is provided an inductor including: a stacked structure; and an external electrode structure formed outside of the stacked structure, wherein the stacked structure: an insulating layer; and a polymer layer is stacked on the insulating layer.

In accordance with the embodiments of the present invention, the polymer layer includes: a plurality of photosensitive polymer insulating layers; and a coil pattern formed on the photosensitive polymer insulating layers.

In accordance with the embodiments of the present invention, the coil pattern is formed by performing a photolithography process and a plating process for the photosensitive polymer insulating layers.

In accordance with the embodiments of the present invention, the insulating layer includes an insulating polymer substrate made of ceramic or polyimide material.

In accordance with the embodiments of the present invention, the polymer layer includes the photosensitive polymer insulating layer having a dielectric constant k below 5.

In accordance with the embodiments of the present invention, the polymer layer further includes: a plurality of coil patterns placed on planes different from each other; and a conductive via provided in the polymer layer so as to electrically connect the coil patterns placed on the planes different from each other.

A method for manufacturing an inductor in accordance with the present invention includes: preparing an insulating layer; forming a polymer layer on the insulating layer; forming a stacked structure by heat treating the insulating layer and the polymer layer; and forming an external electrode for the stacked structure.

In accordance with the embodiments of the present invention, the preparing the polymer layer insulating layer includes: forming a photosensitive polymer insulating layer by coating a photosensitive polymer on the insulating layer; and forming a coil pattern by using a photolithography process and a coating process on the photosensitive polymer layer.

In accordance with the embodiments of the present invention, the forming the coil pattern includes: forming a seed layer on the insulating layer; forming a resist pattern on the seed layer; and forming a metal coating layer by using the seed layer selectively exposed by the resist pattern as a seed.

In accordance with the embodiments of the present invention, after the forming the metal coil layer, the method for manufacturing an inductor in accordance with the present invention includes further includes: removing the resist pattern and the seed layer.

In accordance with the embodiments of the present invention, the preparing the insulating layer includes: preparing an insulating polymer substrate made of a ceramic based or a polyimide based material.

In accordance with the embodiments of the present invention, the forming the polymer layer includes: coating a photosensitive polymer having a dielectric constant below 5 on the insulating layer.

In accordance with the embodiments of the present invention, the forming the polymer layer includes: forming a photosensitive polymer insulating layer on the insulating layer; forming a plurality of coil patterns on the photosensitive polymer insulating layer; and forming a conductive via on the polymer layer so as to electrically connect the coil patterns placed on the planes different from each other.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments. Terms used herein are provided to explain embodiments, not limiting the present invention. Throughout this specification, the singular form includes the plural form unless the context clearly indicates otherwise. Further, terms "comprises" and/or "comprising" used herein specify the existence of described components, steps, operations, and/or elements, but do not preclude the existence or addition of one or more other components, steps, operations, and/or elements.

Hereinafter, an inductor in accordance with the embodiments of the present invention and a method for manufacturing the same will be described in detail with reference to the following drawings.

Figure 1:
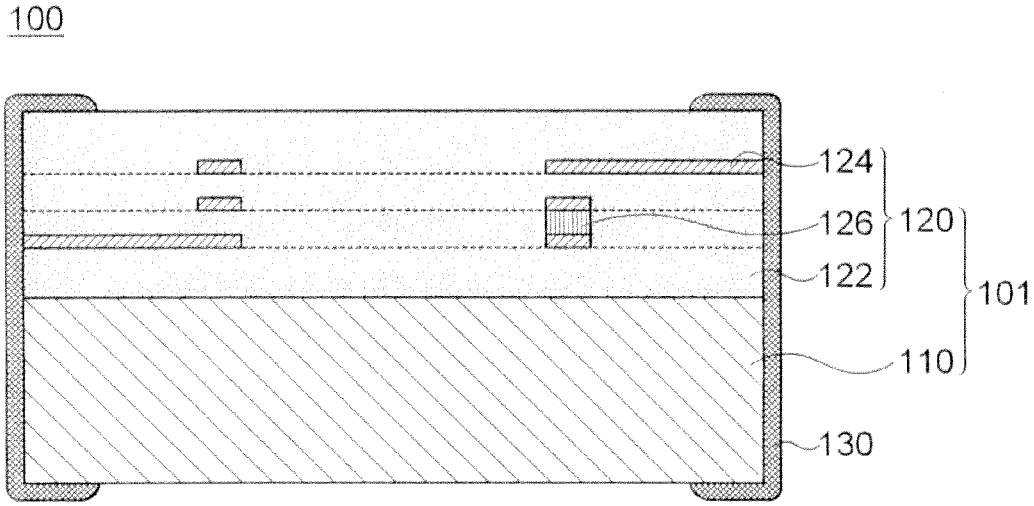
FIG. 1 is a cross-sectional view showing an inductor in accordance with an embodiment of the present invention.

FIG. 1 is a cross-sectional view showing an inductor in accordance with an embodiment of the present invention. Referring to FIG. 1, the inductor 100 in accordance with the present invention can include a stacked structure 101 and an electrode structure 130 formed on an outside of the stacked structure 101. The stacked structure 101 can include an insulating layer 110 and a polymer layer 120 stacked on the insulating layer 110.

The insulating layer 110 may be a base substrate for manufacturing the inductor 100. The insulating layer 110 can include an insulating substrate. As one example, the insulating layer 110 can include a substrate made of ceramic. As another example, the insulating layer 110 can include an insulating polymer substrate made of a polyimide material.

The polymer layer 120 can include a photosensitive polymer insulating layer 122, a coil pattern 124 and a conductive via 126. At least one photosensitive polymer insulating layer 122 may be stacked on the insulating layer 110. If the photosensitive polymer insulating layer 122 is provided in plural, a plurality of photosensitive polymer insulating layers 122 may form a top and bottom stacked structure on the insulating layer 110.

The coil pattern 124 may have a shape wound several times on the same plane on the photosensitive polymer insulating layers 122. The wound number and a detail structure of the coil pattern 124 may be changed variously. And also, the coil patterns 124 arranged on the photosensitive polymer insulating layers 122 different from each other may have structures different from each other. The coil pattern 124 may be formed of various types of metal materials. For example, the coil pattern 124 may be formed of a metal material including at least one among Cu, Ag, Au, Al and Ni.

The conductive via 126 can electrically connect the coil patterns 124 arranged on the planes different from each other. In order for this, a top portion of the conductive via 126 is connected to the coil pattern 124 formed on any one of the photosensitive polymer insulating layer 122, and a bottom portion thereof may be connected to the coil pattern 124 formed on another photosensitive polymer insulating layer 122.

On the other hand, it is preferable that the photosensitive polymer insulating layer 122 is made of a low-k polymer material having a dielectric constant below 5. More specifically, the factors to determine an inductance value and a Q value of the inductor 100 may be a dielectric constant of the dielectric material, a length and an area of the coil pattern 124 and a stray capacitance, e.g., a capacitance between wirings, between the coil patterns 124 or the like. As using a material having a low dielectric constant k of the insulating material, i.e., a dielectric material, formed thereon the coil pattern 124 among such factors, the Q characteristics of the inductor 100 may be increased by reducing the stray capacitance. Whereas, if the ceramic material having a relatively high dielectric constant is used for the layer formed thereon the coil pattern 124, the Q value of the inductor 100 must be reduced. Therefore, the inductor 100 in accordance with the present invention can increase the Q characteristics of the inductor by forming the polymer layer 120 formed thereon the coil pattern 24 with a low-k polymer material having a dielectric constant relatively below 5.

And also, the coil pattern 124 may be a metal pattern formed by using a photolithography process and a plating process. More specifically, the coil pattern 124 may be formed by performing the plating process for the seed layer exposed by the resist pattern as a seed, after forming the metal seed layer on the insulating layer 110 by using the insulating layer 110 as a base substrate. In this case, the coil pattern 124 is formed by using a screen printing method and a thick layer process, whereas the formation of the coil pattern 124 relatively fine pitched may be available.

The external electrode structure 130 may be an electrode terminal formed on an outside of the stacked structure 101. The external electrode structure 130 can include a plus terminal and a minus terminal. The terminals may be electrically connected to the coil pattern 124 of the polymer layer 120. In order to electrically connect the coil pattern 124 and the external electrode structure 130, a predetermined lead wire (not shown) may be further included in the polymer layer 120.

As above, the inductor 100 in accordance with the embodiments of the present invention includes the insulating layer 110 and the polymer layer, stacked on the insulating layer 110, having the coil pattern 124, and the polymer may have a low dielectric constant polymer material having a dielectric constant below 5. Accordingly, the inductor in accordance with the present invention may have high Q value characteristics by reducing the stray capacitance between the coil patterns by using the layer formed thereon the coil patterns as the polymer material having the low dielectric constant.

And also, the inductor in accordance with the embodiments of the present invention includes the insulating layer 110 and the polymer layer 120 stacked on the insulating layer 110, and the polymer layer 120 may include the photosensitive polymer insulating layer 122 and the coil pattern 124 formed on the photosensitive polymer insulating layer 122 using the photolithography process and the plating process. In this case, the coil pattern 124 can allow the fine metal patterning to have a fine line width, in comparison with the coil pattern formed by using the screen printing and the thick layer process or the like. Accordingly, the inductor in accordance with the present invention easily controls the inductance by providing with the fine pitched coil pattern and has a structure to reduce the deviation of the designed inductance.

Figure 2:
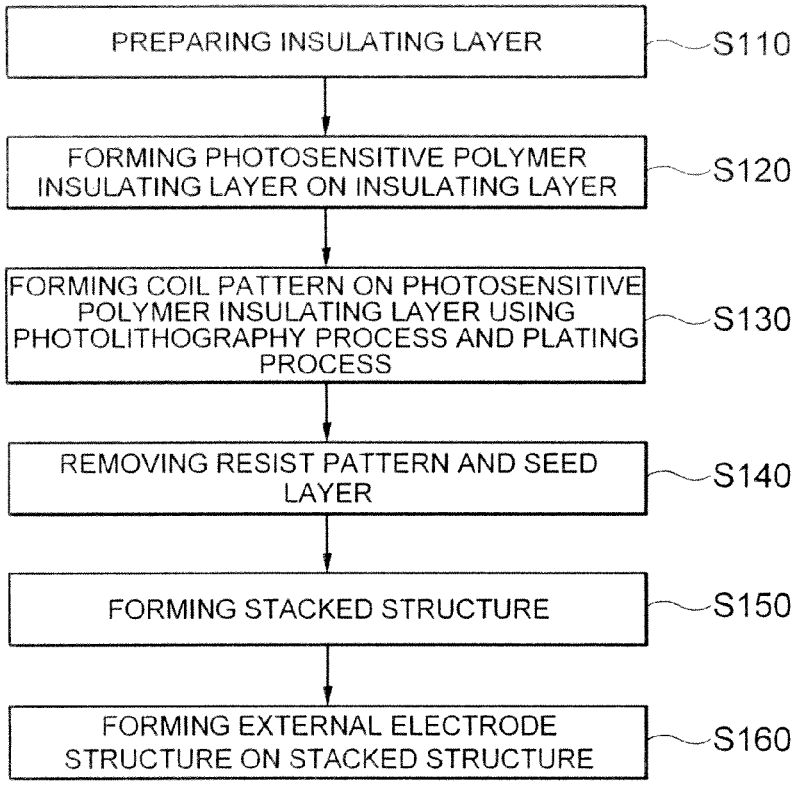
FIG. 2 is a flowchart showing a method for manufacturing an inductor in accordance with another embodiment of the present invention.

FIG. 2 is a flowchart showing a method for manufacturing an inductor in accordance with another embodiment of the present invention; and FIGS. 3 to 7 are diagrams explaining a method for manufacturing an inductor in accordance with embodiments of the present invention.

Figure 3:
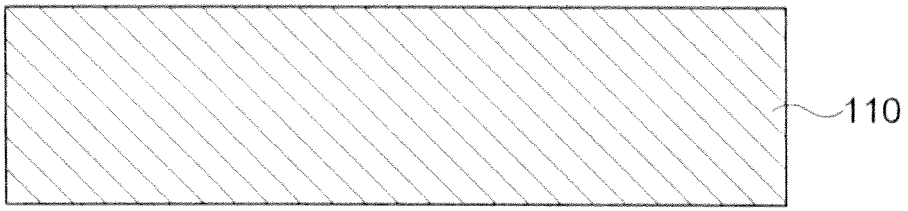
FIGS. 3 to 7 are diagrams explaining a method for manufacturing an inductor in accordance with embodiments of the present invention.

Referring to FIG. 2 and FIG. 3, the insulating layer 110 may be prepared S110. Various types of insulating substrates may be as the insulating layer 110. As one example, the ceramic substrate may be used as the insulating layer 110. As another example, the insulating polymer substrate made of a polyimide based material may be used as the insulating layer 110.

If the insulating layer 110 is prepared, the polymer layer 120 can be formed on the insulating layer 110. Hereinafter, the step for forming the polymer layer 120 will be described in detail.

Figure 4:
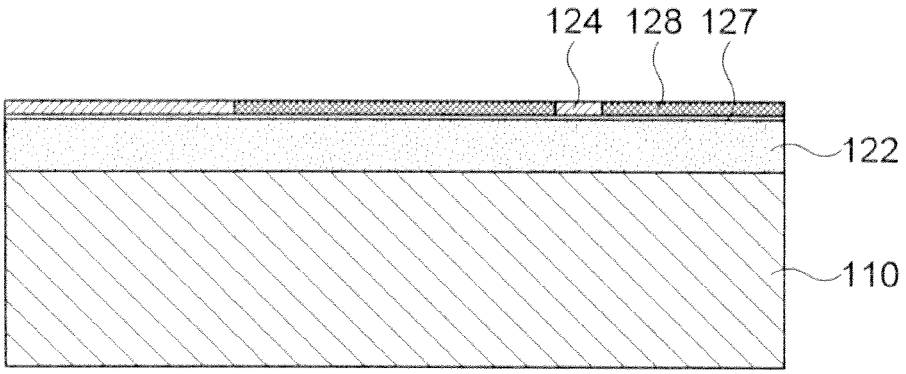

Referring to FIG. 2 and FIG. 4, a photosensitive polymer insulting layer 122 can be formed on the insulating layer 110 S120. In the forming the photosensitive polymer insulating layer 122, the step for coating the photosensitive polymer to the insulating layer 110 can be included. Herein, a polymer having a relatively low dielectric constant may be used as the photosensitive polymer. Accordingly, an insulating layer having a low dielectric constant which is controlled below 5 may be formed on the insulating layer 110.

By using the photolithography process and the plating process, the coil pattern 124 can be formed on the photosensitive polymer insulating layer 122 S130. For example, the step for forming the coil pattern 124 can includes a step for forming a seed layer 127 on the photosensitive polymer insulating layer 122, a step of forming a resist pattern 128 on the seed layer 127, a step for forming a metal pattern by performing a plating process using the seed layer 127 selectively exposed by the resist pattern 128 as a seed and a step for sequentially removing the resist pattern 128 and the seed layer 127 so as to allow only the metal pattern to selectively remain on the photosensitive polymer insulating layer 122.

Various types of metal layer forming processes may be used as the process for forming the seed layer 127. As one example, the step for forming the seed layer 127 may be realized by performing the metal sputtering process for the photosensitive polymer insulating layer 122. Besides, the step for forming the seed layer 127 may be implemented by performing a CVD (Chemical Vapor Deposition) and an ALD (Atomic Layer Deposition) or the like to the photosensitive polymer insulating layer 122.

The step for forming the resist pattern 128 can include a step for forming the resist layer on the seed layer 127 and a step for performing a photolithography process to the resist layer so as to selectively expose the region of the seed layer 127 formed thereon the coil pattern 124.

And, the metal plating process to use the seed layer 127 as a seed can be performed to the resulted structure formed thereon the resist pattern 128. As one example, the seed layer 127 may be a copper metal layer, and a copper plating process may be used as the plating process. Accordingly, in the region of the seed layer 127 selectively exposed by the resist pattern 128, the copper metal pattern can be formed. Herein, since the resist pattern 128 is the resulted structure formed by using the photolithography process, it is capable of forming the copper metal pattern with a fine line width.

Figure 5:
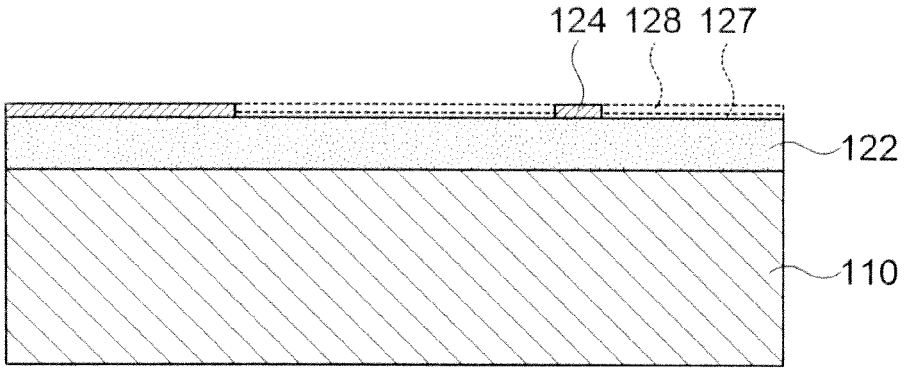

Referring to FIG. 2 and FIG. 5, the resist pattern 128 and the seed layer can be removed S140. The process for removing the resist pattern 128 may be implemented by performing a predetermined strip process. The strip process may be implemented by supplying the stripper having an etching selectivity to the resist pattern 128 in comparison with the metal pattern to the resulting structure formed thereon the resist pattern 128. And, the process for removing the seed layer 127 exposed due to the removal of the resist pattern 128 can be performed. The process for removing the seed layer 127 may be implemented by performing a predetermined etching process. The etching process may be implemented by using the etchant having an etching selectivity to the seed layer 127 in comparison with the metal pattern.

Figure 6:
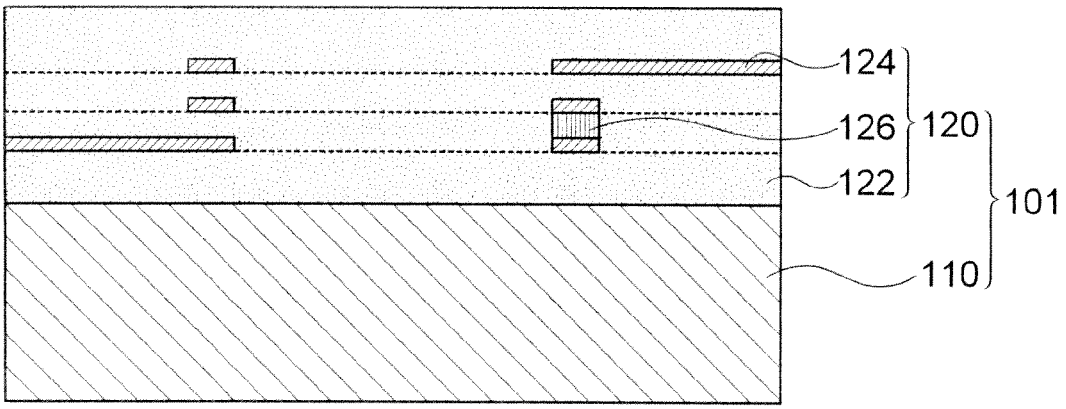

Referring to FIG. 2 and FIG. 6, the stacked structure 101 can be formed S150. For example, by repeatedly performing the process for forming the polymer layer 120, the structure stacked thereon a plurality of polymer layers 120 can be formed on the insulating layer 110. Accordingly, the stacked structure 101 obtained by stacking the insulating layer 110 and the polymer layer 120 can be formed. The stacked type chip structure for manufacturing the stacked type inductor may be manufactured by performing a predetermined heat treatment (curing) process for such stacked structure 101.

On the other hands, the process for forming the polymer layer 120 can further include a step for forming a conductive vies 126 to electrically connect top and bottom terminals to the coil patterns 124 in order to electrically connect the coil patterns 124 placed on the planes different from each other by being formed on the polymer layers 120.

Figure 7:
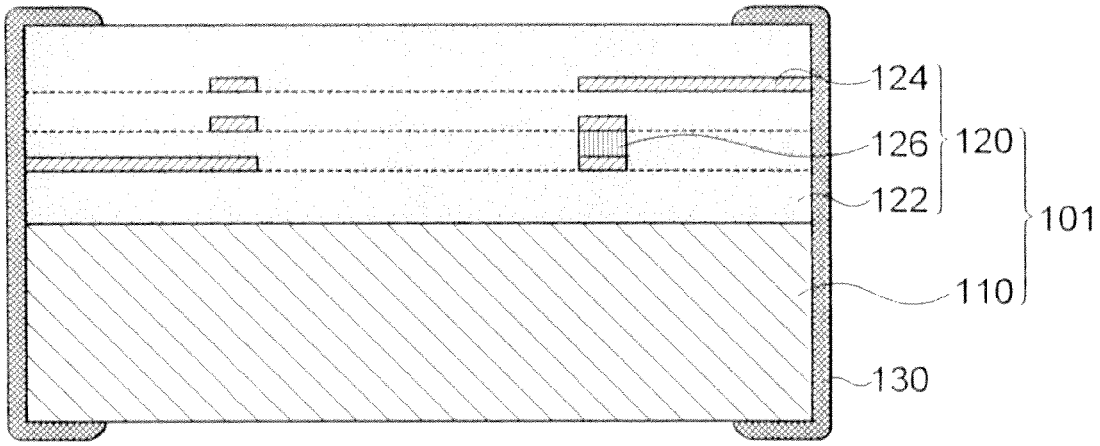

Referring to FIG. 2 and FIG. 7, the stacked structure 101 can form an external electrode structure 130. The step for forming the external electrode 130 can include a step for forming a metal layer to cover both ends of the stacked structure 101. The metal layer may be electrically connected to the coil pattern 124 formed on the polymer layer 120 of the stacked structure 101.

As above, the method for manufacturing the inductor in accordance with the embodiments of the present invention prepares the insulating layer 110 and forms the polymer layer 120 having the coil pattern 124 on the insulating layer 110, wherein the photosensitive polymer insulating layer 122 of the polymer layer 120 can be formed with a polymer material having a relatively low dielectric constant. Accordingly, the method for manufacturing the inductor in accordance with the present invention can manufacture the inductor having the high Q value characteristics by forming the layer formed thereon the coil pattern with the polymer material having a low dielectric constant.

And also, the method for manufacturing the inductor in accordance with another embodiment of the present invention prepares the insulating layer 110, after forming the photosensitive polymer insulating layer 122 on the insulating layer 110, and the coil pattern 124 can be formed on the photosensitive polymer insulating layer 122 by using the photolithography process and the plating process. In this case, the coil pattern 124 can be formed with a fine metal pattern having a fine line width. Accordingly, since the method for manufacturing the inductor is available for forming the coil pattern with the fine pattern having the fine pitch, the inductance can be easily controlled and the deviation of designed inductance can be reduced.

The inductor in accordance with the present invention may have the high Q value characteristics by reducing a stray capacitance between the coil patterns by using the layer formed thereon the coil patterns with the polymer material having a low dielectric constant.

The inductor in accordance with the present invention may have a structure to easily control the inductance and reduce the deviation of the designed inductance by being provided with a fine pitched coil pattern.

The method for manufacturing the inductor in accordance with the present invention may have the high Q value characteristics by reducing a stray capacitance between the coil patterns by using the layer formed thereon the coil patterns with the polymer material having a low dielectric constant.

The method for manufacturing the inductor in accordance with the present invention may have a structure to easily control the inductance and reduce the deviation of the designed inductance by being provided with a fine pitched coil pattern.

The preferable embodiments of the present invention were described above with reference to the accompanying drawings. The accompanying drawings and the above-described embodiments are provided as examples to help understanding of those skilled in the art. Therefore, the various embodiments of the present invention may be embodied in different forms in a range without departing from the essential concept of the present invention, and the above-described embodiments should be regarded as illustrative rather than restrictive. Accordingly, the scope of the present invention should be interpreted from the above-described embodiments rather than the invention defined in the claims, and it is apparent that various modifications, substitutions, and equivalents by those skilled in the art are included in the scope of the present invention.

What is claimed is:

1. A method for manufacturing an inductor comprising:

preparing an insulating layer;

forming a polymer layer including a photosensitive polymer insulating layer and a coil pattern on the insulating layer;

forming a stacked structure by heat treating the insulating layer and the polymer layer; and forming an external electrode to electrically connect the coil pattern for the stacked structure, wherein the insulating layer and the photosensitive polymer insulating layer are respectively made of materials different from each other, the photosensitive polymer insulating layer is made of a polymer material having a dielectric constant below 5, and the insulating layer is made of a non-photosensitive material.

2. The method according to claim 1, wherein the forming the coil pattern includes:

forming a seed layer on the insulating layer;

forming a resist pattern on the seed layer; and forming a metal coating layer by using the seed layer selectively exposed by the resist pattern as a seed.

3. The method according to claim 2, after the forming the metal coil layer, further comprising:

removing the resist pattern and the seed layer.

4. The method according to claim 1, wherein the preparing the insulating layer includes:

preparing an insulating polymer substrate made of a ceramic based or a polyimide based material.

5. The method according to claim 1, wherein the forming the polymer layer includes:

coating the photosensitive polymer insulating layer having a dielectric constant below 5 on the insulating layer.

6. The method according to claim 1, wherein the forming the polymer layer includes:

forming the photosensitive polymer insulating layer on the insulating layer;

forming a plurality of coil patterns on the photosensitive polymer insulating layer; and forming a conductive via on the polymer layer so as to electrically connect the coil patterns.

* * * * *